US011130255B2

(12) United States Patent
Fisher

(10) Patent No.: US 11,130,255 B2
(45) Date of Patent: Sep. 28, 2021

(54) METHOD OF PRODUCING A THERMALLY MODIFIED AND IMPREGNATED WOODEN PRODUCT

(71) Applicant: Trey Michael Fisher, Polson, MT (US)

(72) Inventor: Trey Michael Fisher, Polson, MT (US)

( * ) Notice: Subject to any disclaimer, the term of this patent is extended or adjusted under 35 U.S.C. 154(b) by 126 days.

(21) Appl. No.: 15/985,467

(22) Filed: May 21, 2018

(65) Prior Publication Data

US 2019/0351574 A1 Nov. 21, 2019

(51) Int. Cl.

| | |
|---|---|
| ***B27K 3/08*** | (2006.01) |
| ***B27K 3/02*** | (2006.01) |
| *B27K 3/15* | (2006.01) |
| *B27K 3/34* | (2006.01) |

(52) U.S. Cl.
CPC ..... *B27K 3/08* (2013.01); *B27K 3/0214* (2013.01); *B27K 3/15* (2013.01); *B27K 3/34* (2013.01)

(58) Field of Classification Search
CPC ..... B27K 3/08; B27K 3/0207
See application file for complete search history.

(56) References Cited

U.S. PATENT DOCUMENTS 855,552 A 6/1907 Aylsworth
2011/0301286 A1* 12/2011 Harrup ..... C07F 9/65815 524/598
2013/0153087 A1* 6/2013 Bies ..... B27M 1/08 144/364
2017/0239836 A1* 8/2017 Zhan ..... B27N 9/00

OTHER PUBLICATIONS

Poncsak, S., Shi, S. Q., Kocaefe, D., and Miller, G. (2007). "Effect of thermal treatment of wood lumbers on their adhesive bond strength and durability," J. Adhes. Sci. Technol 21(8), 745-754. DOI: 10.1163/156856107781362653.
Sernek, M., Boonstra, M., Pizzi, A., Despres, A., and Gerardin, P. (2008). "Bonding performance of heat treated wood with structural adhesives," Holz Als Roh-Werkst 66(3), 173-180. DOI: 10.1007/s00107-007-0218-0.
Kariz, M., Kuzman, M.K., and Sernek, M. (2013). "The effect of the heat treatment of spruce wood on the curing of melamine-urea-foraldehyde and polyurethane adhesives," J. Adhes. Sci. Technol. 27(17), 1911-1920. DOI: 10.1080/01694243.2013.764809.
(Continued)

*Primary Examiner* — Nathan T Leong
(74) *Attorney, Agent, or Firm* — Williams Intellectual Property; Timothy Snyder

(57) ABSTRACT

A method of producing a thermally modified and impregnated wooden product is described herein. One or more pieces of wood are thermally modified. The thermally modified wood is formed into a wooden object by hand, tool, machine, a computer numerical controlled machine, or combinations thereof. The wooden object is then impregnated with one or more treatment agents to produce the thermally modified and impregnated wooden product. The wooden object is impregnated by applying pressure or heat while the object is in the presence of the one or more treatment agents. Minimal, if any, deformation of the thermally modified wooden object occurs during impregnation.

18 Claims, 3 Drawing Sheets

(56) References Cited

OTHER PUBLICATIONS

Tjeerdsma, B.F., Boonstra, M., Pizzi, A., Tekely, P., and Militz, H. (1998). "Characterisation of thermally modified wood: molecular reasons for wood performance improvement," Holz als Roh-und Werkstoff 56(3), 149-153. DOI: 10.1007/s001070050287.

Sivonen, H., Maunu, S. L., Sundholm, F., Jamsa, S., and Viitaniemi, P. (2002), "Magnetic resonance studies of thermally modified wood," Holzforschung 56(6), 648-654. DOI: 10.1515/HF.2002.098.

Esteves, B., Graca, J., Pereira, H. (2008). "Extractive composition and summative chemical analysis of thermally treated eucalypt wood," Holzforschung 62(3), 344-351. DOI: 10.1515/HF.2008.057.

Chen, Y., Fan, Y., Gao, J., and Stark, N.M. (2012). "The effect of heat treatment on the chemical and color change of black locust (*Robinia Pseudoacacia*) wood flour," BioResources 7(1), 1157-1170.

Tjeerdsma, B.F., and MIlitz, H. (2005). "Chemical changes in hydrothermal treated wood: FTIR analysis of combined hydrothermal and dry heat-treated wood," Eur. J. Wood & Wood Prod. 63(2), 102-111. DOI: 10.1007/s00107-004-0532-8.

Nuopponen, M., Vuorinen, T., Jamsa, S., and Viitaniemi, P. (2005). "Thermal modifications in softwood studied by FT-IR and UV resonance Raman spectroscopies," J. Wood Chem. Technol. 24(1), 13-26. DOI: 10.1081/WCT-120035941.

Sundqvist, B., and Moren, T. (2002). "The influence of wood polymers and extractives on wood colour induced by hydrothermal treatment," Eur. J. Wood & Wood Prod. 60(5), 375-376. DOI: 10.1007/s00107-002-0320-2.

Esteves, B., Velez Marques, A., Domingos, I., and Pereira, H. (2007). "Heat-induced colour changes of pine (*Pinus pinaster*) and eucalypt (*Eucalyptus globulus*) wood," Wood Sci. Technol. 42(5), 369-384. DOI: 10.1007/s00226-007-0157-2.

Petrissans, M., Gerardin, P., and Serraj, M. (2003). "Wettability of heat-treated wood," Holzforschung 57(3), 301-307.

Hakkou, M., Petrissans, M., El Bakali, I, Gerardin, P., and Zoulalian, A. (2005). "Wettability changes and mass loss during heat treatment of wood," Holzforschung 59(1), 33-37. DOI: 10.1515/HF.2005.006.

Metsa-Kortelainen, S., and Viitanen, H. (2012). "Wettability of sapwood and heartwood of thermally modified Norway spruce and Scots pine," Eur. J. Wood Prod. 70(1), 135-139. DOI: 10.1007/s00107-011-0523-5.

* cited by examiner

METHOD OF PRODUCING A THERMALLY MODIFIED AND IMPREGNATED WOODEN PRODUCT

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

There are several methods of treating wood to improve the properties and characteristics thereof for any given application. One such method is thermal-modification, also referred to as thermo-curing, thermo modification, baking, roasting, thermal-stabilization, among other names. Thermal-modification is accomplished through various methods, including hot oil treatment, steam treatment, and pressurized nitrogen-atmosphere treatment. All thermal modification methods involve heating the wood to varied temperatures that may range from 160° C. to 190° C. Time frames for full thermal modification vary, depending upon the treatment applied. While most methods can be complete within 72 hours, some methods involve a curing, drying, and conditioning process that can last seven days. Every method of thermal modification causes a pyrolytic transformation in the chemical structure of lignin, cellulose, and hemicellulose components of the wood. Although thermal-modification of wood often leaves many wood species more rigid and durable, the treatment also makes many species less flexible and often brittle.

Another method of treatment is the impregnation of wood with various treatment agents. Impregnating wood with various treatment agents can improve the wood's properties such as strength, durability, water resistance, dimensional stability, resistance to degradation, and fire resistance. A conventional method of impregnating wood involves immersing the wood in one or more treatment agents and applying pressure to force the treatment agents into the wood. This typically occurs in a large container such as an autoclave. Other passive impregnation methods are also known in the art including spraying, diffusion, and soaking the wood in one or more treatment agents without the application of pressure. The penetration of the treatment agent into the wood is therefore directly dependent on the exposure time of the treatment agent and/or the amount of pressure applied. The penetration may further be improved by heating the wood and treatment agent during impregnation. However, such techniques of using pressure, heat, or a combination thereof may cause the wood to distort, warp, shrink, or otherwise deform from its original shape. In addition, wood impregnation currently takes place on a large scale to impregnate as much wood as possible for a given impregnation cycle. This requires large processing facilities utilizing monstrously sized autoclaves, which may increase operating costs, increase costs to the consumer, and reduce the number of potential suppliers.

Further, these impregnation techniques have not been applied to dimensionally formed, thermally modified wooden products (e.g., wood formed/constructed into a final end-user product or a constituent thereof). Otherwise, such a method may be advantageous to produce a readily available wooden product having superior properties and/or characteristics. Such a method may further reduce overall manufacturing costs, specialize the impregnation process for a given wood species or wooden product, and/or streamline production for companies that manufacture wooden products.

Thus, there exists a need in the art for a method of producing a thermally modified and impregnated wooden product that has been dimensionally pre-formed prior to impregnation and resists deformation during impregnation.

FIELD OF THE INVENTION

The present invention generally relates to methods of treating wood, and more particularly, to a method of producing a thermally modified and impregnated wooden product.

SUMMARY OF THE INVENTION

The general purpose of the method of producing a thermally modified and impregnated wooden product, described subsequently in greater detail, is to provide a method of producing a thermally modified and impregnated wooden product which has many novel features that result in a method of producing a thermally modified and impregnated wooden product which is not anticipated, rendered obvious, suggested, or even implied by prior art, either alone or in combination thereof.

A method of producing a thermally modified and impregnated wooden product is provided herein. In a particular embodiment of the method, a pre-formed thermally modified wooden object is impregnated with one or more treatment agents to produce the thermally modified and impregnated wooden product. The impregnation may include the application of pressure and heat to the thermally modified wooden object while the object is in the presence of one or more treatment agents. The impregnation may include the application of pressure to the thermally modified wooden object while the object is in the presence of a treatment agent recipe. The impregnation may further include the application of pressure and heat to the thermally modified wooden object while the object is in the presence of a treatment agent recipe. The resulting thermally modified and impregnated wooden product has substantially the same dimensions as the pre-formed thermally modified wooden object.

The pre-formed thermally modified wooden object may be in the shape of dimensioned lumber, musical instruments, dimensioned building materials, furniture, outdoor wood products, gun stocks, fencing, fence posts, wood-poles, decking material, siding, watercraft products, aircraft products, flooring, statues, artwork, frames, sports equipment, tools, handles, ledgers, baskets, animal and livestock containment and housing structures, wooden weaponry, blocks, toys, or other crafted wooden objects.

The one or more treatment agents may be natural or synthetic and may include at least one of oil, polymerizing agents, lacquering agents, plasticizing agents, varnishing agents, and combinations thereof.

Another method of producing a thermally modified and impregnated wooden product is also provided. At least one piece of wood is thermally modified and subsequently formed into a wooden object by hand, tool, machine, a computer numerical control machine, or a combination thereof. The wooden object is then impregnated with one or more treatment agents to produce the thermally modified and impregnated wooden product, where the thermally modified and impregnated wooden product has substantially the same dimensions as the wooden object.

Thus has been broadly outlined the more important features of the present method of producing a thermally modified and impregnated wooden product so that the detailed description thereof that follows may be better understood and in order that the present contribution to the art may be better appreciated.

Objects of the present method of producing a thermally modified and impregnated wooden product, along with various novel features that characterize the invention are particularly pointed out in the claims forming a part of this disclosure. For better understanding of the method of producing a thermally modified and impregnated wooden product, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1A:
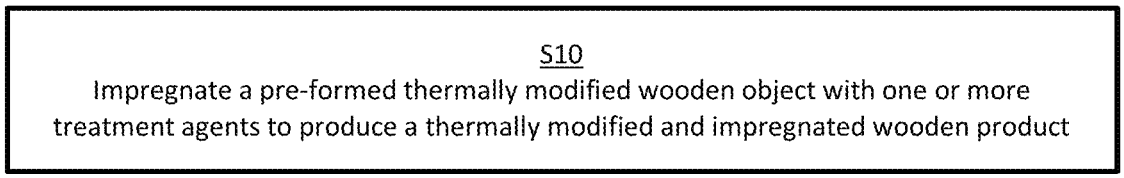
FIG. 1A is a flowchart of a method of producing a thermally modified and impregnated wooden product in accordance with embodiments of the invention.

The present invention has utility as a method of producing a thermally modified and impregnated wooden product that is pre-formed prior to impregnation and resists deformation during impregnation. The present invention is particularly advantageous for producing a wooden product that has at least one of increased strength, ultraviolet-resistance, dimensional stability, moisture resistance, heat resistance, tonal qualities, fungal resistance, insect resistance, flexibility, punch-through resistance, fire resistance, deep-freeze-damage resistance, bacterial resistance, contagion resistance, chemical resistance, salt-damage resistance, marine invasive-species resistance, terrestrial invasive species resistance, structural integrity, or a combination thereof. Further, the present invention may produce wooden products with deep-colorization combined with deep-strengthening as well as enhanced fire resistance and even produce wooden products having fire retardation substances introduced deep into the wooden product. Finally, embodiments of the methods described herein may further reduce overall operating/manufacturing costs, specialize the impregnation process for a given wood species or wooden product, and/or streamline production for companies that manufacture wooden products. The following description of various embodiments of the invention is not intended to limit the invention to those specific embodiments, but rather to enable any person skilled in the art to make and use this invention through exemplary aspects thereof.

It is to be understood that in instances where a range of values are provided, the range is intended to encompass not only the end point values of the range but also intermediate values of the range as explicitly being included within the range and varying by the last significant figure of that range. By way of example, a recited range of 1 to 4 is intended to include 1-2, 1-3, 2-4, 3-4, and 1-4.

As used herein, the term "treatment agent" refers to an agent or substance for treating wood. The "treatment agent" may be natural or synthetic. Examples of "treatment agents" include oil, polymers, polymerizing agents, lacquering agents, plasticizing agents, and varnishing agents. More particularly, the "treatment agents" may include vegetable oils (drying, semi-drying, or non-drying oils), epoxidized oils (epoxidized jatropha oil), synthetic oils, bioplastics (polylactide), polyesters, polystyrene, acrylate polymers, poly(methyl methacrylate), polycarbonates, comonomers (such as butyl acrylate and methacrylic acid), copolymers, epoxies, natural resins, acrylic resins, shellac, lacquers, nitrocellulose lacquers, plasticizers, thinning solvents, pigments, tints, stains, and dies. Thinning solvents may further include acetone, n-Butanol, dimethylformamide (DMF), ethylbenzene, glycol ethers (such as 2-butoxyethanol), methyl ethyl ketone (MEK), mineral spirits, n-butyl acetate, naphtha, toluene, turpentine, xylene, citrus solvent, and other thinners.

As used herein, the term "treatment agent recipe" refers to a mixture of two or more treatment agents to aid in impregnation.

Also as used herein, the term "pre-formed thermally modified wooden object" refers to an object made of wood that has been: a) thermally modified; and b) crafted, shaped, formed, assembled, or dimensioned into a final end-user product, a constituent thereof, or considerably crafted, shaped, formed, or otherwise dimensioned to that end (e.g., a wooden product that is greater than 50% formed into a final end-user product, or a constituent thereof). Examples of pre-formed thermally modified wooded objects are described below with reference to FIG. 2A at S14.

With reference now to the drawings, and in particular FIGS. 1A through 2B thereof, examples of the instant method of producing a thermally modified and impregnated wood product employing the principles and concepts of the present method of producing a thermally modified and impregnated wooden product will be described.

Referring to FIG. 1A, a particular embodiment of a method of producing a thermally modified and impregnated wooden product is illustrated. The method includes impregnating a pre-formed thermally modified wooden object with one or more treatment agents to produce the thermally modified and impregnated wooden product (Block S10). The pre-formed thermally modified wooden object may be sprayed, painted, soaked, and/or immersed in one or more treatment agents, but to effect a deeper penetration of the treatment agent into the wooden object, at least one of the following may be required: a) the application of pressure and heat; b) the application of pressure and a treatment agent recipe; or c) the application of pressure, heat, and a treatment agent recipe. Therefore, in one embodiment, impregnating the pre-formed thermally modified wooden object may include applying pressure and heat to the wooden object while the object is in the presence of one or more treatment agents. In another embodiment, impregnating the wooden object includes applying pressure to the wooden object while the object is in the presence of a treatment agent recipe. While in a further embodiment, impregnating the wooden object includes applying pressure and heat to the wooden object while the object is in the presence of a treatment agent recipe.

The impregnation may occur in an impregnation container, such as an autoclave, capable of controlling containment pressure and temperature necessary for each specific treatment agent recipe, wooden object, wooden species, or combinations thereof. The pre-formed thermally modified wooden object may be placed inside the impregnation container, where one or more treatment agents are pumped into the container to immerse (either partially or completely) the wooden object therein. The wooden object is subsequently impregnated using any of the aforementioned techniques (e.g., application of pressure, heat, treatment agent recipe, or a combination thereof). In some embodiments, prior to immersing the wooden object in the treatment agent(s), air or fluid may be removed from the container with the wooden object therein by reducing the pressure inside the container. Removing air may improve the impregnation. Further, it should be appreciated, that the depth of impregnation may be dependent upon the species of the wooden object, the thickness at one or more regions of the wooden object, a pressure-component of one or more treatment agents, a heat component of one or more treatment agents, the treatment agents themselves, and any combination thereof, all of which may be adjusted accordingly to improve penetration depth and/or create a wooden product having specific characteristics and/or properties without deviating from the scope of the invention. It should further be appreciated, that the pressures and temperatures required to effect penetration for a given wood species, treatment agent(s), and/or wooden product may be known in the art and/or determined experimentally without deviating from the scope of the invention.

Advantageously, the resulting thermally modified and impregnated wooden product has substantially the same dimensions as the pre-formed thermally modified wooden object. In other woods, impregnating a pre-formed thermally modified wooden object results in minimal, if any, deformation of the wooden object during impregnation. In some embodiments, the term 'substantially' refers to 0% to 1% dimensional deformation of the wooden object during impregnation. In other embodiments, 'substantially' refers to 1% to 5% dimensional deformation of the wooden object during impregnation. Further, it should be appreciated, that although some species of wood may deform more than others during impregnation, this deformation is easily addressed by varying the treatment agent recipe based upon the wood species.

Figure 1B:
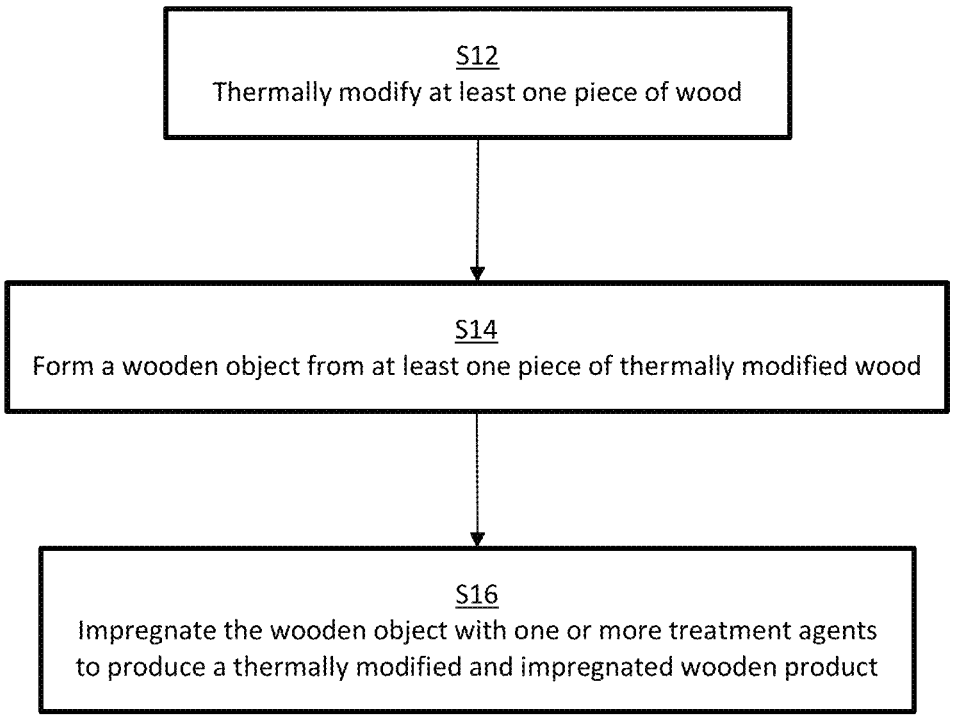
FIG. 1B is a flowchart of another method of producing a thermally modified and impregnated wooden product in accordance with embodiments of the invention.
Figure 2A:
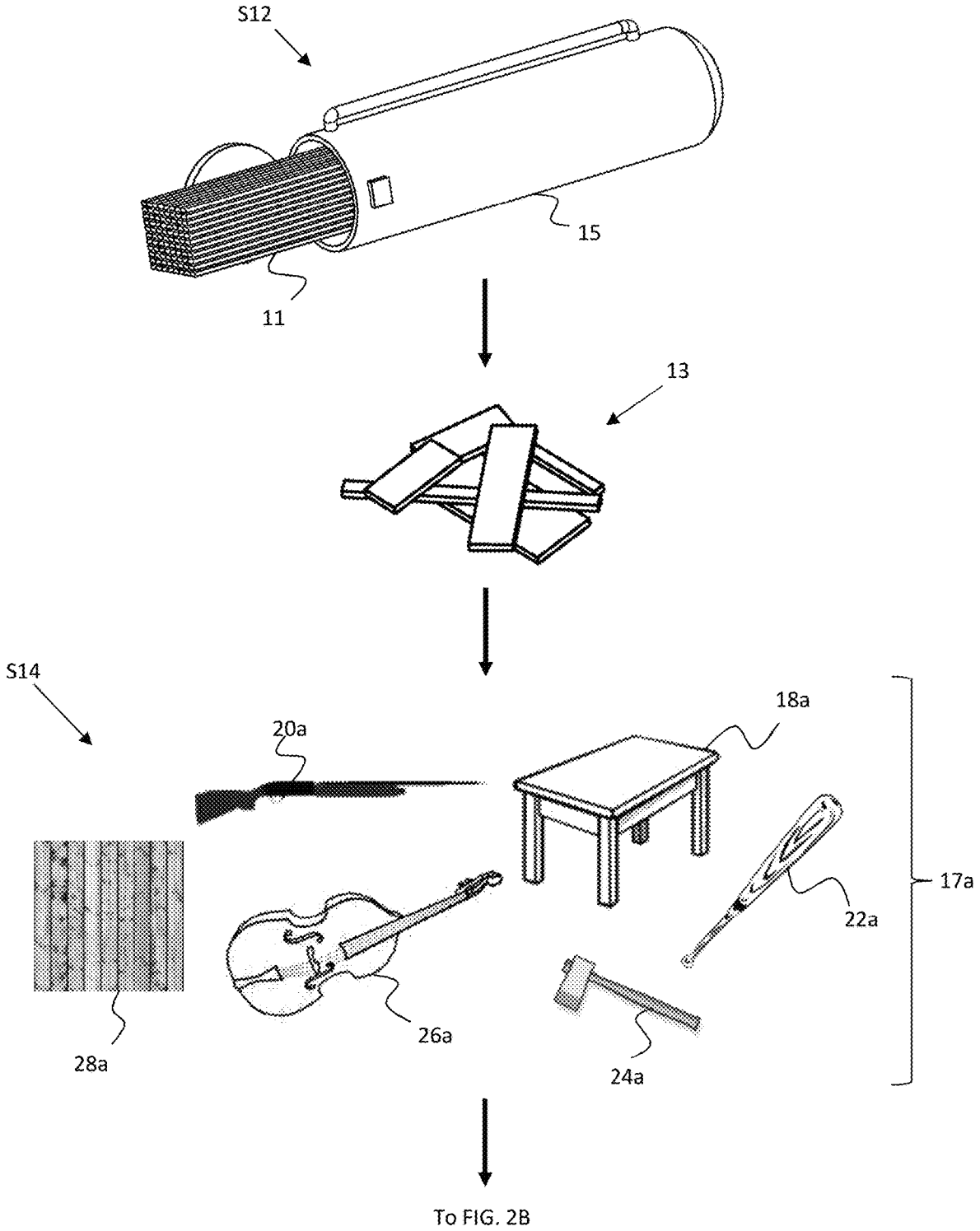
FIG. 2A illustrates a first portion of method of producing a thermally modified and impregnated wooden product in accordance with embodiment of the invention.
Figure 2B:
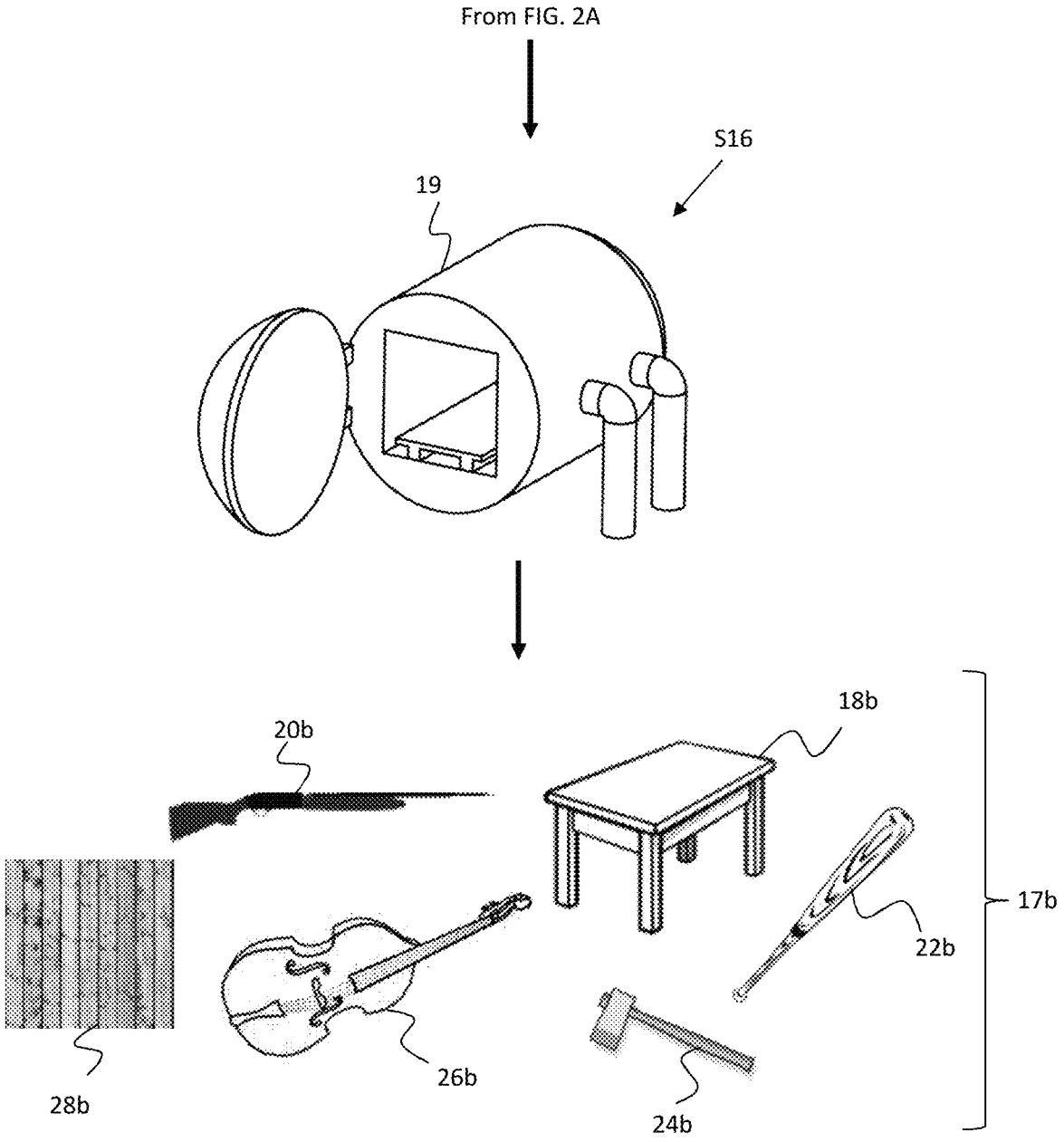
FIG. 2B illustrates a second portion of a method of producing a thermally modified and impregnated wooden product in accordance with embodiment of the invention.

Referring to FIGS. 1B through 2B, a specific embodiment of a method of producing a thermally modified and impregnated wooden product is shown, where FIG. 1B is a flowchart thereof, and FIGS. 2A and 2B pictorially illustrate the method thereof. The method includes: thermally modifying at least one piece of wood 11 (Block S12); forming a wooden object 17*a* from at least one piece of thermally modified wood 13 (Block S14); and impregnating the wooden object 17*a* with one or more treatment agents to produce a thermally modified and impregnated wooden product 17*b* (Block S16).

At least one piece of wood 11 may be obtained from conventional sources and thermally modified by a controlled pyrolysis process (e.g., Westwood process, Plato process, oil heat treatment). In some embodiments, the piece(s) of wood 11 is kiln-dried in an oven using techniques known in the art prior to thermal modification.

The thermally modified wood 13 is then formed into a wooden object 17*a*. The wooden object 17*a* may be formed by modifying the thermally modified wood by hand, tool, machine, a computer numerical (CNC) machine, or a combination thereof. The wooden object 17*a* may be further formed by assembling two or more pieces of the aforementioned modified wood. For example, a first piece of thermally modified wood may be modified into the shape of a table top, while a second piece of thermally modified wood is modified into the shape of table legs, where the table top and table legs are subsequently assembled to form a wooden table 18*a*. In any case, the resulting formed wooden object refers to an object that has been crafted, shaped, formed, assembled, or dimensioned into a final end-user product, a constituent thereof, or considerably crafted, shaped, formed, or otherwise dimensioned to that end (e.g., a wooden product that is greater than 50% formed into a final end-user product, or a constituent thereof). Examples of formed wooden objects 17*a*, as illustrated in FIGS. 2A and 2B, include a table 18*a*, gun stocks 20*a*, sporting equipment 22*a*, tools 24*a*, musical instruments 26*a*, and dimensioned lumber 28*a*. Other examples of formed wooden objects 17*a* include dimensioned building materials, furniture, outdoor wood products, fencing, fence posts, wood-poles, dimensioned wood for interior and exterior applications, decking materials, siding, watercraft, aircraft, flooring, statures, artwork, frames, handles, ledgers, baskets, animal and livestock containments, housing structures, wooden weaponry, blocks, toys, and other crafted wooden objects. It should be appreciated, that the aforementioned examples of formed wooden products 17*a* likewise exemplify the pre-formed thermally modified wooden object as described herein.

After forming the wooden object 17*a*, the wooden object 17*a* is impregnated using any of the aforementioned impregnation techniques (Block S16) (e.g., applying pressure, heat, a treatment agent recipe, or a combination thereof). The impregnation may occur in an impregnation container 19, such as an autoclave, for controlling the containment pressure and temperature therein as described above. The wooden object 17*a* may be partially or completely immersed in the one or more treatment agents. The resulting product is a thermally modified and impregnated wooden product 17*b*. Advantageously, the dimensions of the thermally modified and impregnated wooden product 17*b* are substantially the same as the wooden object 17*a*. The term 'substantially' here has the same aforementioned meaning.

In particular embodiments, the impregnation container 19 may be considerably reduced in size compared to traditional industrial sized autoclaves since the wood is already formed. In some embodiments, the impregnation container 19 may be a benchtop device for impregnating smaller wooden products. In other embodiments, the interior geometry of the impregnation container 19 may be sized and/or dimensioned to fit one or more particular products to streamline manufacturing. In a further embodiment, the impregnation container 19 is industrial in size but specialized for a particular wooden product. Overall, it should be appreciated, that by forming the wooden objects 17*a* prior to impregnation, the final product may have superior properties and/or characteristics and may reduce overall manufacturing costs, specialize the impregnation process for a given wood species or wooden product, and/or streamline production for companies that manufacture wooden products.

What is claimed is:

1. A method of producing a thermally modified and impregnated wooden product, comprising:

providing a pre-formed and dimensioned thermally modified wooden object wherein the thermally modified wooden object is formed into a final end-user product;

impregnating the thermally modified wooden object with one or more treatment agents by applying heat to the wooden object while in the presence of the one or more treatment agents to produce a thermally modified and impregnated wooden product, wherein the thermally modified and impregnated wooden product has substantially the same dimensions as the pre-formed and dimensioned thermally modified wooden object.

2. The method of claim 1 wherein the impregnation comprises applying pressure and heat to the thermally modified wooden object while the object is in the presence of one or more treatment agents.

3. The method of claim 1 wherein the impregnation comprises applying pressure to the thermally modified wooden object while the object is in the presence of a treatment agent recipe.

4. The method of claim 3 wherein impregnation further comprises applying heat to the thermally modified wooden object while the object is in the presence of the treatment agent recipe.

5. The method of claim 4 wherein the application of pressure and heat occurs in an autoclave.

6. The method of claim 5 wherein the pre-formed thermally modified wooden object is in the shape of dimensioned lumber, musical instruments, dimensioned building materials, furniture, outdoor wood products, gun stocks, fencing, fence posts, wood-poles, decking material, siding, watercraft products, aircraft products, flooring, statues, artwork, frames, sports equipment, tools, handles, ledgers, baskets, animal and livestock containment and housing structures, wooden weaponry, blocks, or toys.

7. The method of claim 1 wherein the one or more treatment agents are natural or synthetic and includes at least one of oil, polymerizing agents, lacquering agents, plasticizing agents, varnishing agents, and combinations thereof.

8. A method of producing a thermally modified and impregnated wooden product, comprising:

thermally modifying at least one piece of wood;

forming a wooden object from the thermally modified wood to form a dimensioned thermally modified wooden object, wherein the thermally modified wooden object is formed into a final end-user product; and impregnating the dimensioned thermally modified wooden object with one or more substances by applying heat to the wooden object while in the presence of the one or more substances to produce a thermally modified and impregnated wooden product;

wherein the thermally modified and impregnated wooden product has substantially the same dimensions as the dimensioned thermally modified wooden object.

9. The method of claim 8 wherein thermally modifying the at least one piece of wood comprises modifying the wood by a controlled pyrolysis process.

10. The method of claim 9 wherein thermally modifying the at least one piece of wood further comprises kiln drying the at least one piece of wood prior to modifying the at least one piece of wood by a controlled pyrolysis process.

11. The method of claim 8 wherein forming the wooden object comprises modifying at least one piece of thermally modified wood by hand, tool, machine, computer numerical control machining, or a combination thereof.

12. The method of claim 11 wherein forming the wooden object further comprises assembling two or more pieces of modified wood.

13. The method of claim 12 wherein the wood object is in the shape of dimensioned lumber, musical instruments, dimensioned building materials, furniture, outdoor wood products, gun stocks, fencing, fence posts, wood-poles, decking material, siding, watercraft products, aircraft products, flooring, statues, artwork, frames, sports equipment, tools, handles, ledgers, baskets, animal and livestock containment and housing structures, wooden weaponry, blocks, or toys.

14. The method of claim 8 wherein the impregnation comprises applying pressure and heat to the thermally modified wooden object while in the presence of one or more treatment agents.

15. The method of claim 8 wherein the impregnation comprises applying pressure to the thermally modified wooden object while in the presence of a treatment agent recipe.

16. The method of claim 15 wherein impregnation further comprises applying heat to the thermally modified wooden object while in the presence of the treatment agent recipe.

17. The method of claim 8 wherein the one or more treatment agents are natural or synthetic and include at least one of oil, polymerizing agents, polymers lacquering agents, plasticizing agents, varnishing agents, and combinations thereof.

18. The method of claim 17 wherein the one or more treatment agents further includes at least one of vegetable oils, epoxidized oils, bioplastics, synthetic drying oils, epoxies, shellac, acrylics, acrylic glass, natural resins, acrylic resins, acrylate polymers, poly(methyl methacrylate), polycarbonates, nitrocellulose lacquers, comonomers, copolymers, thinning solvents, pigments, and dyes.

* * * * *